United States Patent [19]

Beaver et al.

[11] Patent Number: 4,726,891

[45] Date of Patent: Feb. 23, 1988

[54] FLAT PLATE BIPOLAR CELL

[75] Inventors: Richard N. Beaver, Angleton; Hiep D. Dang, Lake Jackson, both of Tex.

[73] Assignee: The Dow Chemical Company, Midland, Mich.

[21] Appl. No.: 906,474

[22] Filed: Sep. 12, 1986

[51] Int. Cl.[4] ..... C25B 9/00; C25B 11/02; B23K 31/02

[52] U.S. Cl. ..... 204/268; 204/288; 204/254; 228/179

[58] Field of Search ..... 204/254–256, 204/286–288, 268, 178–179

[56] References Cited

U.S. PATENT DOCUMENTS

| | | | |
|---|---|---|---|
| 3,950,239 | 4/1976 | Figueras | 204/254 |
| 4,115,236 | 9/1978 | Smura | 204/254 |
| 4,139,448 | 2/1979 | Wallace | 204/286 X |
| 4,141,815 | 2/1979 | Ichisaka et al. | 204/254 X |
| 4,402,809 | 9/1983 | Dilmore et al. | 204/255 X |
| 4,425,214 | 1/1984 | Pellegri | 204/286 X |
| 4,581,114 | 4/1986 | Morris et al. | 204/254 X |

*Primary Examiner*—Donald R. Valentine

*Attorney, Agent, or Firm*—Jay C. Taylor

[57] ABSTRACT

A flat plate bipolar electrolytic cell frame unit has a plurality of connectors removably attachable to the centerboard. Anode and cathode plate supports or ribs have outer plate supporting edges and are cooperable with the connectors, when the latter are secured to the centerboard, to enable adjustment of the ribs to preselected positions whereat their edges define preselected planes, such that when the anode and cathode plates are subsequently welded to said edges and assembled with the connectors to the centerboard, the anode and cathode plates of adjacent bipolar cell units are parallel and closely spaced by a predetermined distance. The connectors are removably secured to the centerboard and the ribs are welded at their adjusted positions to their respective connectors. Thereafter the welded together connectors and ribs are removed from the centerboard to enable unencumbered welding of the anode and cathode plates to said edges of the anode and cathode ribs respectively. The connectors, with the ribs welded thereto and with the anode and cathode plates welded to their respective anode and cathode ribs, are then reassembled to the centerboard.

17 Claims, 4 Drawing Figures

FLAT PLATE BIPOLAR CELL

The present invention relates to improvements in a flat plate bipolar electrolytic cell and method of manufacture.

BACKGROUND AND OBJECTS OF THE INVENTION

A typical bipolar electrolytic cell comprises a number of bipolar cell units arranged in series. Each unit comprises parallel anode and cathode plates spaced by a partition or centerboard which is attached to an outer frame or peripheral flange. In each unit, the centerboard may comprise a form sustaining steel plate confronting and spaced from the cathode plate, and a titanium sheet lined or bonded to the steel plate and confronting and spaced from the anode plate. A low resistance electrical connection between the anode and cathode plates may also include means for supporting the plates in parallelism with each other.

In a typical construction illustrated in U.S. Pat. No. 4,111,779, the anode plate is a titanium foraminous sheet or woven wire mesh spaced from the anode sheet of the partition by a plurality of titanium ribs welded to both the anode plate and titanium sheet. The cathode plate comprises a steel foraminous or woven wire sheet spaced from the steel partition plate by a plurality of steel ribs welded to both the steel partition plate and cathode plate. Inasmuch as the partition frequently has a slight initial bow which tends to increase when welded to the titanium and steel ribs, the outer edges of the ribs welded to the cathode and anode plates are frequently not parallel. It is important to maintain closely spaced parallelism between the cathode and anode plates of adjacent bipolar units in order to achieve a uniform potential gradient and current flow therebetween throughout their surface areas. If the desired parallelism is not closely maintained, the space between these plates must be sufficiently large to avoid electrical contact and short circuits, resulting in an undesirably low potential gradient between various portions of the plates. Also the resulting nonuniform distribution of current flow and electrolytic action can cause increased cell voltage, localized overheating, and shortened cell life. In order to minimize such defects, the edges of the ribs remote from the partition are machined to the desired parallelism before being welding to the anode and cathode plates. The precision machining however is time consuming and costly.

U.S. Pat. No. 4,194,670 to Ichisaka et al provides a bipolar cell free from the above noted defects and wherein the anode and cathode plates are supported in parallelism with each other. In that construction, the various ribs welded to their respective anode or cathode plate are also welded at adjusted positions to a number of spaced connectors which in turn are welded to the partition. Prior to welding the ribs to their respective connectors, the ribs are adjustably supported in a welding fixture to assure that the outer edges of the ribs that will be subsequently welded to the associated anode or cathode plate will support that plate in a predetermined plane and at a predetermined distance from the partition. Thereafter the associated plate, the anode plate for example, is welded to the outer edges of the titanium ribs and supported thereby in the predetermined plane. The steel cathode ribs are similarly supported in adjusted positions by means of welding fixtures and thereafter welded to the various connectors which have previously been welded to the steel plate of the partition. The cathode plate is then welded to the outer edges of the steel ribs remote from the partition to obtain the desired horizontal spacing between the anode and cathode plates.

Although it is alleged in the specification of U.S. Pat. No. 4,194,670 that the desired parallelism between the anode and cathode plates is obtained, it is technically difficult to achieve continuous resistance welding of the anode and cathode plates to their respective ribs between the adjacent connectors because, unlike the condition prevailing in U.S. Pat. No. 4,111,779, the ribs are spaced from the partition at the regions thereof between the connectors. In consequence thermally induced warping or buckling of the anode and cathode plates from their desired condition of parallelism occurs at the regions that are not positively welded to their supporting ribs. Furthermore, the resistance welding of the anode plate to its titanium ribs results in electrical sparking in the gap between the ribs and the titanium sheet of the partition with consequent damage to the thin anode partition sheet.

Important objects of the present invention are to avoid the above noted objections and to provide an improved bipolar electrolytic cell and method of construction whereby the anode and cathode plates may be welded to their respective anode and cathode ribs before these ribs are secured by their respective connectors to the partition.

Another important object is to provide an improved bipolar cell of the type described comprising a plurality of anode and cathode connectors removably secured to the anode and cathode sides respectively of the centerboard or partition. A plurality of titanium anode plate supporting ribs are spaced across the surface of the anode plate and arranged at predetermined positions of adjustment with respect to the titanium connectors and welded thereto at the adjusted positions whereat the outer edges of the ribs define a predetermined plane for supporting the anode plate. The anode plate is resistance welded to said outer edges of the titanium ribs and is thus supported in a predetermined plane spaced from the partition. Similarly the cathode plate is resistance welded to a plurality of steel cathode ribs spaced over the surface of the cathode plate. Each cathode rib is welded at a predetermined adjusted position to each of a plurality of connectors which in turn are removably secured to the partition, whereby the cathode plate is also supported at a predetermined location in parallelism with the anode plate.

Other objects are to provide an improved bipolar cell that enables a preferred method of construction to assure positive support for the anode and cathode plates of adjacent cell units in precisely spaced parallelism with each other, and to provide an improved method for fabricating such a cell wherein the anode and cathode connectors are first removably secured to the centerboard or partition. Thereafter the partition (attached to the connectors) and the plate supporting ribs are supported by a welding jig in predetermined adjusted positions such that the outer edges of the ribs remote from the partition define predetermined parallel planes for supporting the anode and cathode plates at their desired parallel positions. The ribs are then welded at their adjusted positions to their respective connectors, whereupon the connectors (welded to the ribs) are removed from the partition. The anode and cathode plates are then welded to the outer edges of their respective ribs by conventional resistance welding procedure. The assemblies of the ribs welded to their respective anode and cathode plates and to their respective anode and cathode connectors are then assembled to the partition by virtue of the removably attachable connectors.

Another important object of this invention is to provide an improved bipolar cell with removably attachable connectors which enable the electrode plates to be disassembled from the centerboard of the cell frame for repair or recoating and thereafter reassembled to the centerboard.

Other objects of this invention will appear in the following description and appended claims, reference being had to the accompanying drawings forming a part of this specification wherein like reference characters designate corresponding parts in the several views.

THE PRIOR ART

In addition to the U.S. Pat. Nos. 4,111,779 and 4,194,670 which illustrate the state of the art as noted above, U.S. Pat. No. 4,141,815 to Ishisaka et al illustrates structure similar to that of U.S. Pat. No. 4,194,670 and is subject to the same shortcomings. No prior art is known that teaches the concept of connector means removably attachable to the centerboard of a bipolar cell in combination with plate supporting ribs welded to the connector means at predetermined positions of adjustment with respect to the centerboard, whereby outer edges of the ribs define predetermined planes for supporting the anode and cathode plates of adjacent cell units at preselected closely spaced parallel locations, in an arrangement whereby the connector means and ribs welded thereto can be removed from the centerboard and welded to said plates along said edges and thereafter reassembled to the partition by virtue of the removably attachable connector means.

BRIED DESCRIPTION OF THE DRAWINGS

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

BRIEF DESCRIPTION OF THE INVENTION

Figure 1:
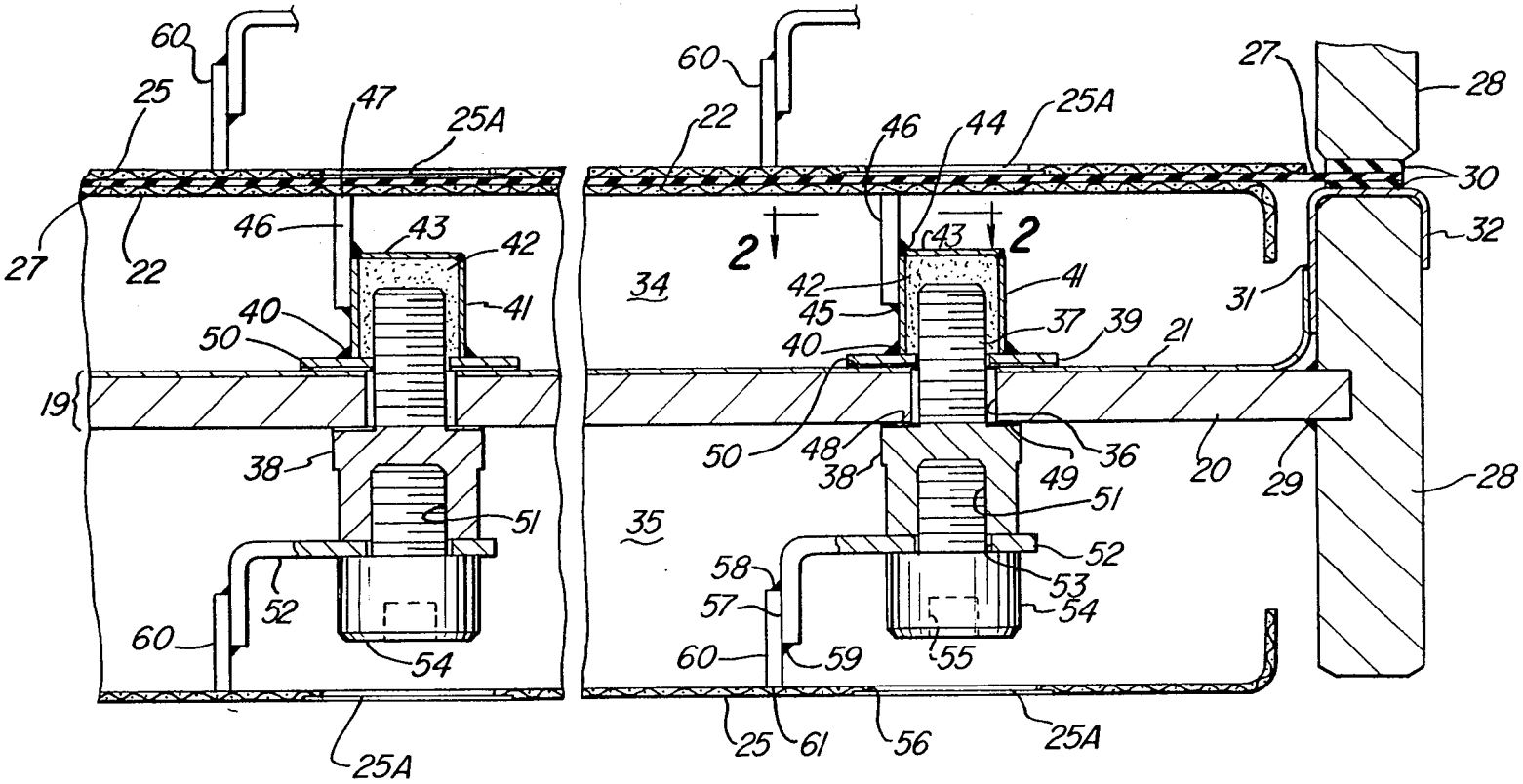
FIG. 1 is a fragmentary schematic cross sectional view through a bipolar electrolytic cell embodying the present invention.

Referring to the drawings and in particular to FIG. 1, the bipolar electrolytic cell illustrated is conventional in concept and operation and comprises a cation exchange membrane separating an anode from a cathode. Cells of the type illustrated are particularly though not exclusively useful for the electrolysis of alkali halides, such as a sodium chloride anolyte to produce chlorine gas within an anodic chamber and hydrogen gas and sodium hydroxide in a cathodic chamber.

In FIG. 1, a partition or centerboard 19, comprising a steel form-sustaining plate 20 preferably bonded to a titanium liner 21, spaces electrically connected anode and cathode plates 22 and 23 respectively to provide a bipolar unit. A battery of such units are arranged in series within the cell. Although titanium and steel are commonly preferred for use as the anodic and cathodic structures described herein, other metals and alloys known to the art for such use may be substituted. By way of example, such metals as tantalum, tungsten, columbium, zirconium, molybdenum, and alloys thereof, as well as titanium alloys, may be used for the anodic structures. Likewise iron, nickel, lead, molybdenum, cobalt, and alloys thereof including major amounts of these metals alloyed in stainless steel may be used for the cathodic structures.

The anode plate 22 may comprise a foraminous titanium plate, such as a knitted or woven titanium wire mesh, or punched or expanded titanium sheet coated as is conventional with a catalyst to reduce chlorine overvoltage. The cathode plate 25 may comprise a foraminous steel plate, such as a knitted or woven steel wire mesh, or punched or expanded steel sheet for a conventional gap cell. The cell of the present invention may include electrode components other than, or in addition to, the components listed above. For example the mattress structure taught in U.S. Pat. No. 4,444,632 may be used to hold the ion exchange membrane and one of the electrodes in physical contact in a zero gap cell. Other mattress configurations are illustrated in U.S. Pat. No. 4,340,452. The cell may include current collectors which distribute electrical currents to the electrodes of the cells. Current collectors may be used with zero gap cells as well as with solid polymer electrolyte cells. Current collectors are illustrated in, for example, U.S. Pat No. 4,444,641. In a conventional gap cell, the membrane 27 separates each cathode plate 25 from the anode plate 22 of the adjacent bipolar unit.

The steel partition plate 20 of each unit is recessed at its edges into a soft steel peripheral flange 28 and welded thereto at 29 to prevent leakage of electrolyte across the partition 19. The membrane 27 is sealed around its edges between gaskets 30 which also effect seals between adjacent parts of the peripheral flange 28. The titanium sheet 21 may be welded at 31 to a separate titanium side sheet 32 that wraps around the anode portion of the peripheral flange 28. A comparatively low resistance electrical connection between the anode and cathode plates 22 and 23 of each unit comprises a plurality of ribs and connectors described below.

The structure and operation of the cell described thus far may be conventional. For example a sodium chloride anolyte may be supplied to the anodic chamber 34 of each unit through supply ports (not shown) and sodium hydroxide catholyte may be withdrawn from the cathodic chamber 35 through discharge ports (also not shown). During operation, chlorine gas resulting from the electrolysis of the sodium chloride anolyte forms within the chamber 34 and is discharged via vents, not shown. Hydrogen gas resulting from the electrolysis collects within the chamber 35 and is similarly discharged via vents, not shown. The sodium hydroxide catholyte formed within chamber 35 as a result of the electrolysis and cation permeability of the membrane 27, as well as the chlorine and hydrogen gases, are comparatively pure and may be collected for subsequent use.

The electrical connection between the anode and cathode plates is provided through a plurality of bolt holes 36 spaced over the surface of the partition 19 and extending coaxially through both the steel plate 20 and titanium sheet 21. The threaded shank 37 of a copper bolt or connector 38 screws tightly into the threaded bore of a tubular titanium connector 41 of square cross section filled with copper 42 and closed at its outer end remote from the partition 19 by a titanium cap 43. The inner end of the cap 43 close to the partition 19 is welded at 40 to a titanium flange 39. The holes 36 are aligned in rows across the partition 19 and the connectors 41 associated with the aligned holes 36 are welded at 44 and 45 to one of each of a plurality of titanium ribs 46. Each rib 46 extends along a row of the connectors 41 to which it is welded and each rib has an outer edge 47 extending the length of the rib and abutting the titanium anode plate 22 and welded thereto entirely along the length of the edge 47 by conventional resistance welding. One plane surface of each square cross section connector 41 is flush with the rib 46 to which it is welded to effect a positive welded connection, FIG. 2. Tightening and loosening of each copper bolt or connector 38 is facilitated by an enlarged head or external hexagonal portion. The enlarged head provides a shoulder 48 confronting the steel plate 20. Leakage through each hole 36 is prevented by a gasket 49 compacted between the shoulder 48 and plate 20 and also by a gasket, 50 compacted between the titanium flange 39 and titanium partition sheet 21.

Each connector 38 is provided with an internally threaded bore 51 coaxial with the shank 37 and opening endwise outwardly from the partition 19. An L-shaped copper connector 52 provides a bolt hole 53 and is secured to the outer end of each connector 38 by means of a copper capscrew 54 extending through the opening 53 and screwed tightly into the threaded opening 51. Preferably the outer end of each screw 54 is provided with a hexagonal opening 55 accessible through an opening 56 in the cathode collector 25 to receive the mating hexagonal end of a wrench for tightening or loosening the capscrew 54. Each L-shaped connector 52 provides a flat surface 57 parallel to and offset from the ribs 46 and welded at 58 and 59 to one of each of a plurality of parallel steel ribs 60 flush with the surfaces 57. The outer edge 61 of each rib 60 remote from the partition 19 abuts the cathode plate 25 and is welded along its entire length thereto by conventional resistance welding.

The structure described may be fabricated by the following procedure wherein after assembly of the partition 19 and flange 28 and the welding of these parts as described above, and before welding of the ribs 46 and 60 to their respective connectors 41, 52 and to their respective anode and cathode plates 22 and 25, the connectors 41, welded to their associated flanges 39, are secured in place over the bolt holes 36 by means of the connectors 38 as illustrated. Thereafter the assembly including the partition 19, connectors 41, and ribs 46 are supported in a welding jig or fixture in predetermined positions of adjustment with respect to each other such that the outer edges 47 of the ribs 46 define a predetermined plane. Thus when the anode plate 22 is subsequently welded to the edges 47, it will likewise be precisely located at a predetermined alone.

The ribs 46 in their adjusted positions are then welded at 44 and 45 to the connectors 41. Thereafter the connectors 39, 41 and ribs 46 welded thereto are disassembled from the partition 19 by unscrewing the connectors 38 and are supported in a welding jig. The anode 22 is then suitably supported on the edges 47 of the ribs 46 in the plane defined by the edges 47 and welded thereto entirely along their lengths by conventional resistance welding. After welding of the anode 22 to the ribs 46, the assembly of the anode 22, ribs 46, and connectors 39, 41 are again assembled to the partition 19 and secured thereto by tightening the connectors 38.

Similarly, the angle connectors 52 may be assembled to the connectors 38 as illustrated by tightening the capscrews 54. Thereafter the resulting assembly and the ribs 60 are supported in adjusted positions by a welding jig with the outer edges 61 of the ribs 60 located precisely in a plane parallel to the anode 22 and at a predetermined distance therefrom. The ribs 60 in their adjusted positions flush with the plane surfaces of the legs 57 are then welded at 58 and 59 to the connectors 52.

The capscrews 54 are then unscrewed to permit removal of the connectors 52 and ribs 60 welded thereto, which latter assembly is supported in a welding jig. The cathode plate 25 is then assembled on the edges 61 in the predetermined plane determined thereby and welded to the edges 61 entirely along their lengths by conventional resistance welding. The welded together cathode plate 25, ribs 60, and connectors 52 are then reassembled to the connectors 38 as illustrated and secured in place by tightening the capscrews 54.

If desired, the holes 56 may be closed by thin plates 25A of material comparable to the material of the plate 25 and welded to the plate 25, or the disc of material cut out from plate 25 to make each access opening 56 may be replaced within that opening and secured in position by welding the disc to the plate 25 around the periphery of the opening 56, thereby to close the same. The resulting bipolar unit may then be assembled with similarly constructed units as is conventional to complete the bipolar cell.

Although the welding of the ribs 46 and 60 to their respective connectors 41 and 52 is described above in separate operations, if desired such welding can be accomplished in a single operation, depending on the capacity of the welding system. Likewise if desired, the cathode plate 25 may be welded to the ribs 60 as described prior to welding of the anode 22 to the ribs 46. The important consideration is that the connectors 41 and 52 are detachably secured to the partition 19 and are thereafter welded to their respective ribs 46 and 60, which are first adjusted along the plane surfaces of the connectors 41 and 52 as shown until the edges 47 and 61 are precisely located in predetermined planes, such that when the plates 22 and 25 are subsequently welded to the edges 47 and 61 and assembled within the cell, the plates of adjacent cell units will be parallel and precisely spaced by a predetermined distance. By virtue of the removable connectors 41 and 52, after being welded to the ribs 46 and 60, they are removed from the partition 19 to facilitate unhampered welding of the plates 22 and 25 to the edges 47 and 61.

Figure 2:
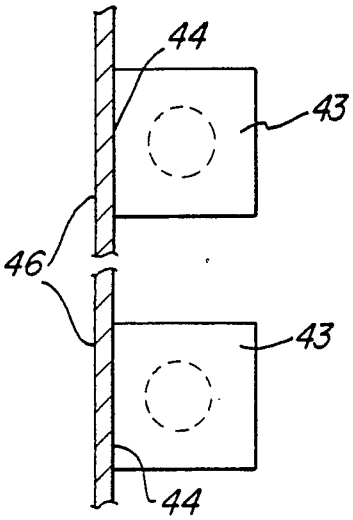
FIG. 2 is a fragmentary sectional view showing the alignment of the connectors along one of the ribs, taken in the direction of the arrows substantially along line 2—2 of FIG. 1.
Figure 3:
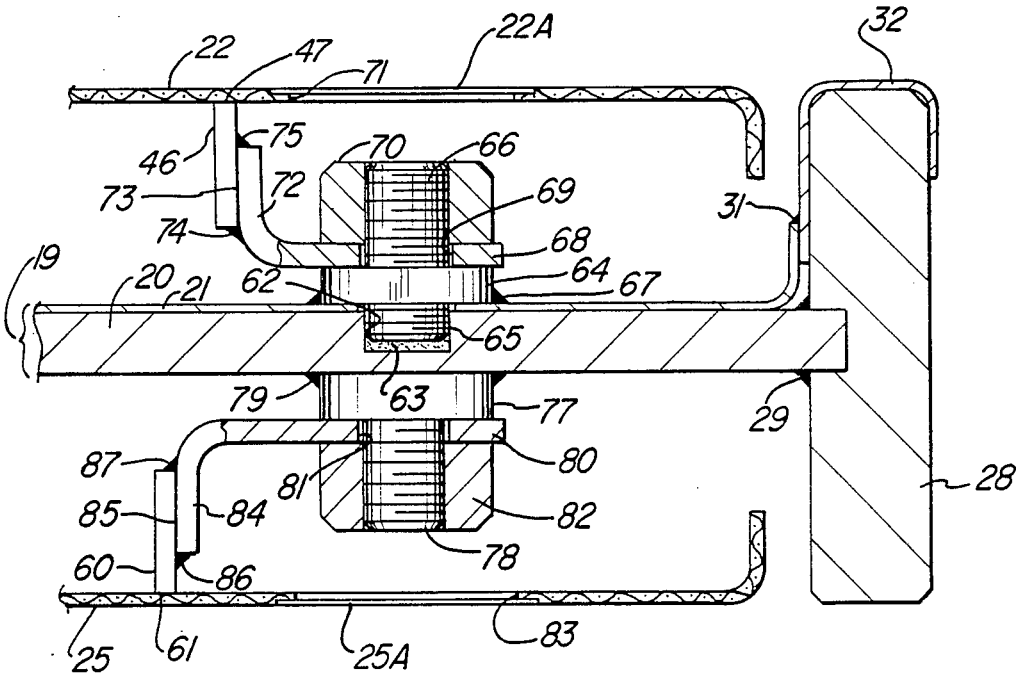
FIG. 3 is a view similar to FIG. 1, showing a modification.
Figure 4:
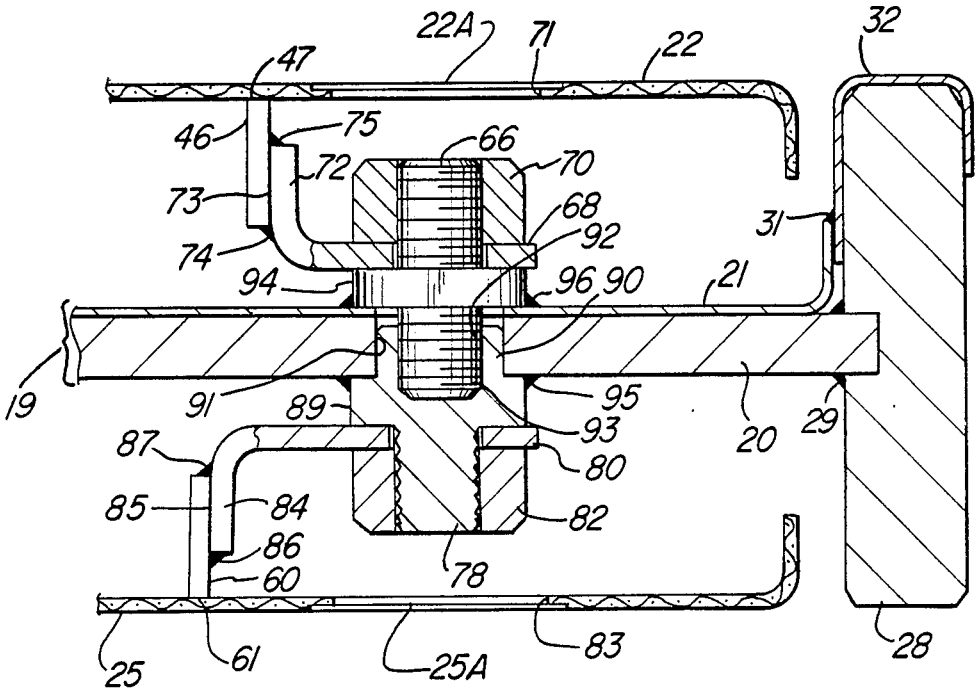
FIG. 4 is a view similar to FIG. 3, showing another modification.

It is to be noted that each connector 41 may be arranged about the axis of its stud 37 before bolt 38 is tightened, so that one plane face of the connector will be parallel to the rib 46 to which it is welded, FIG. 2. Similarly each L-shaped connector 52 may be pivoted about the axis of its screw 54 before the latter is tightened, thereby to assure that the face 57 will also be parallel to the rib 60 to which it is welded. The same type of pivotal adjustment of the L-connectors shown in FIGS. 3 and 4 is also permitted. Also the holes 36 and 53 are sufficiently oversize with respect to the shank 37 and the shank of capscrew 54 to enable radial adjustment of the connector 41 and connector 52 to assure that the plane surfaces of the connectors 41 welded to a rib 46 will engage the proximate surface of that rib in parallelism, and to assure that the surface 57 will also engage the proximate surface of the rib 60, to which the connectors 52 are welded, in parallelism. Thus the confronting surfaces of the ribs 46 and connectors 41 welded thereto, and the confronting surfaces of the ribs 60 and connectors 52 welded thereto may be maintained in parallel engagement with each other while being moved relative to each other to their preselected adjusted positions whereat the outer edges 47 and 61 define the desired planes for supporting the anode and cathode plates 22 and 25. The same considerations also apply to the confronting parallel surfaces of the ribs and L-shaped connectors described in regard to FIGS. 3 and 4.

The parallelism between the anode and cathode plates assured by the present invention enables the use of a minimum inter-electrode gap as is desirable without subjecting the cation exchange membrane to damage or puncturing by excessive contact with the anode or cathode plates as might otherwise occur if these plates were not perfectly parallel.

The connectors welded to the ribs 46 and 60 may be adjustably secured to the partition or centerboard 19 by various means within the concept of the present invention, as illustrated by way of example in FIGS. 1, 3 and 4. FIG. 3 illustrates a variation wherein the overall structure of the partition 19, flange 28, anode and cathode plates 22 and 25, and their associated ribs 46 and 60 are substantially the same as described above. In the FIG. 3 construction, in place of each hole 36 extending completely through the partition 19, an internally threaded recess or well 62 is provided in one side of the partition 19. In the present instance the well 62 extends through the titanium sheet 21 and into the steel plate 20 and is partially filled with copper gauze 63 to assure a superior electrical connection.

A titanium stud bolt 64 having oppositely extending threaded shanks 65 and 66 is tightened to the titanium liner 21 by means of the shank 65 screwed tightly into the well 62. The bolt 64 is then welded at 67 to the titanium sheet 21 entirely around the well 62 in sealing relation to prevent seepage of electrolyte into the well 62. Alternately, a gasket can be placed between the shoulder of the bolt 64 and the titanium sheet 21 to obtain the sealing. An L-shaped titanium connector 68 has a bolt hole 69 in one leg adapted to fit over the threaded shank 66 and is secured in place by a nut 70 screwed tightly on the shank 66 and accessible for tightening or loosening through an opening 71 in the anode plate 22. An outwardly extending leg 72 of the connector 68 provides a face 73 flush with the rib 46 which is welded at 74 and 75 to the leg 72. As described in reference to FIG. 1, the outer edge 47 of the rib 46 is resistance welded along its entire length to the anode plate 22.

A copper connector bolt 77 having a threaded shank 78 extending outwardly from the steel plate 20 and coaxially with the threaded shanks 65 and 66 is welded at 79 to the steel plate 20. Similarly to the connectors 68, each of a plurality of L-shaped copper connectors 80 provides a hole 81 that fits over the threaded shank 78 and is tightly secured to the connector 77 by a nut 82 screwed on the shank 78 and accessible through an opening 83 in the cathode plate 25. Each connector 80 has an outwardly extending leg 84 provided with a plane surface 85 parallel to the associated rib 60 and also parallel to but offset from the rib 48 and the surface 73 of the leg 72 to avoid localized force on the closely spaced plates 22 and 25 during operation of the cell. The rib 60 is welded at 86 and 87 to the several associated connectors 80 flush with the surfaces 85 and is also welded entirely along its outer edge 61 by conventional resistance welding to the plate 25. By virtue of the structure shown in FIG. 3, seals are not required to prevent passage of electrolyte through the partition 19. Furthermore either connector 68 or 80 can be removably secured to the partition 19 independently of the other.

Similarly to the fabrication described above in regard to FIG. 1, after the connectors 64 and 77 are secured in place and welded to the partition 19, the connectors 68 and 80 are secured to the connectors 64 and 77 respectively, either in turn or at the same time, by tightening the nuts 70 and 82. Openings 71 and 83 provide access to the nuts 70 and 82 in the plates 22 and 25. The assembly of the partition 19 and attached frame 28 and removably attached connectors 68 are supported in a welding jig along with the ribs 46 arranged in predetermined adjusted positions flush with the surfaces 73 and with their outer edges 47 defining a predetermined plane to assure the proper location of the anode 22 when the latter is subsequently welded to the edges 47. The ribs 46 are then welded at 74 and 75 in their adjusted positions to the connector legs 72. Thereafter the connectors 68 and ribs 46 welded thereto are disassembled from the partition 19 by unscrewing the nut 70, whereupon the assembly of the connectors 68 and ribs 46 are supported in a welding jig. The anode plate 22 is arranged in the plane defined by the edges 47 and welded thereto by conventional resistance welding entirely along their lengths. Thereafter the assembly of the welded together connectors 68, ribs 46, and anode plate 22 are reassembled to the partition 19 and secured in place by tightening the nuts 70. Each opening 71 is then preferably closed by replacing the disc 22A, that was removed from plate 22 to provide the opening, and by welding each disc 22A in place around its periphery to the plate 22 and flush therewith.

Similarly the connectors 80 are secured in place by the nuts 82, as illustrated. The ribs 60 together with the assembly of the connectors 80, 77, partition 19 and frame 28 are adjustably supported with respect to each other in a welding jig such that the ribs 60 are flush with the associated surfaces 85 and the outer edges 61 of the ribs define a predetermined plane parallel to the plane of the anode 22. The ribs 60 are then welded at 86 and 87 to the legs 84 of the brackets 80. The assembly of the brackets 80 and ribs 60 welded thereto is then removed from the partition 19 by unscrewing the nuts 82 and supported in a welding jig. The cathode plate 25 is laid on the edges 61 in the plane defined thereby and welded thereto entirely along the lengths of the ribs 60. The welded together cathode plate 25, ribs 60 and connectors 80 are then reassembled to the partition 19 and secured in place as illustrated by tightening the nuts 82. The openings 83 may then be closed by thin plates 25A as described above, or by replacing and welding the discs in place that were initially cut out from the plate 25 to provide the opening 83.

As a result of the fabrication procedure described, the desired parallel and minimum spacing between the anode and cathode plates of adjacent bipolar units is assured.

FIG. 4 illustrates a modification wherein the overall arrangement of the partition 19, frame 28, anode and cathode plates 22 and 23, ribs 46 and 60 and their respective connectors 68 and 80 is the same as the corresponding structures described above in regard to FIGS. 1 and 3.

In FIG. 4, a copper connector bolt 89 has an externally threaded shaft 90 screwed tightly into an internally threaded hole 91 through the partition 19. The shaft 90 has a coaxial internally threaded bore 92 into which is tightly screwed the threaded shank 93 of a titanium anode connector 94. The connector 89 is sealingly welded at 95 to the steel plate 20 entirely around the opening 91 to prevent seepage of electrolyte into that opening. Alternately, a gasket can be placed between the shoulder of the connector 89 and the steel plate 20 to obtain the sealing. Similarly the titanium connector 94 is sealingly welded at 96 to the titanium sheet 21 entirely around the opening 91. Alternately, a gasket can be placed between the shoulder of the titanium connector 94 and the titanium sheet 21 to obtain the sealing. The titanium connector 94 has a threaded shaft 66 extending outwardly from the partition 19 and coaxially with the threaded portions 91 and 92. Similarly the copper connector 89 has a threaded shaft 78 extending coaxially with the shaft 66 and outwardly from the partition 19. The remaining structure in FIG. 4 and the method of fabrication enabled thereby to assure the desired parallelism and spacing between the anode and cathode plates is the same as described in regard to FIG. 3.

We claim:

1. The combination in a bipolar electrolytic cell having a series of side-by-side cell units, each unit comprising a peripheral flange, a partition secured to the peripheral flange and comprising a composite structure of parallel anode and cathode side sheets, an anode plate spaced from the anode side of the partition, and a cathode plate spaced from the cathode side of the partition, said combination comprising means associated with each cell unit for supporting the cathode and anode plates of adjacent units at predetermined locations in closely spaced parallelism and for effecting an electrical connection between the anode and cathode plates of the associated cell unit comprising a plurality of anode and cathode connector means, means for removably securing said anode and cathode connector means at spaced locations on the anode side and cathode side respectively of the partition of the associated cell unit, the first named means also including means for accommodating variations in the surface contours of said partition and for supporting the anode and cathode plates of the associated cell unit in parallelism at predetermined spaced locations comprising a plurality of anode and cathode plate supports having anode and cathode plate supporting edges respectively and being individually adjusted relative to said anode and cathode connector means respectively to adjusted positions whereat their anode and cathode plate supporting edges at each anode and cathode side define a predetermined plane parallel to the other such plane independently of variations in the distances between each said plane and said partition, said anode and cathode plate supports being welded at said adjusted positions to said anode and cathode connector means respectively, and said anode and cathode plate supporting edges being welded to said anode and cathode plates respectively of the associated cell unit.

2. The combinations according to claim 1, each plate support and connector means to which it is welded has juxtaposed surfaces arranged to remain in juxtaposition and to enable adjustment of said plate supports and edges thereof toward and from said partition to said adjusted positions prior to being welded to said connector means.

3. The combination according to claim 1, the connector means at one side of said partition comprising means for removably securing the welded together plate support and plate (at said one side in said predetermined adjusted position) to the connector means (at the other side of said partition) for removal from said partition.

4. The combination according to claim 1, each anode and cathode connector means including an anode and a cathode connector respectively, each connector having a face transverse to the parallel cathode and anode plates, said anode and cathode plate supports being welded at said adjusted positions to said faces respectively of said anode and cathode connectors.

5. The combination according to claim 1, the connector means on one side of said partition comprising a plurality of connectors, and connector means on the opposite side of said partition comprising a plurality of connector bolts associated with said connectors respectively, each connector having an internally threaded recess opening toward said one side, said partition having a plurality of bolt holes associated and aligned with said recesses, and means for sealing each bolt hole to prevent passage of electrolyte therethrough comprising a portion of each connector around the opening of its recess confronting said one side around the associated bolt hole, each connector bolt having a threaded shank and extending through one of said bolt holes and screwed tightly into the associated threaded recess, and a shoulder of each connector bolt engaging said opposite side of said partition around the bolt hole through which the shank of the connector bolt extends.

6. The combination according to claim 5, each connector bolt having an enlarged head providing said shoulder, each head having an internally threaded recess opening away from said opposite side, said connector means at said opposite side also comprising a plurality of connectors associated with said connector bolts respectively and welded to the plate support at said opposite side, each last named connector having a screw hole aligned with the recess in the head of the associated connector bolt, and means for removably securing said last named connector to the enlarged head of the associated connector bolt comprising a capscrew having a threaded end extending through said screw hole in the connector and screwed tightly into the aligned threaded recess.

7. The combination according to claim 5, said connector means at said opposite side comprising a plurality of connectors associated with said connector bolts respectively and welded to the plate support at said opposite side, and screw threaded means for removably securing the last named connectors to their associated connector bolts.

8. The combination according to claim 1, said anode and cathode connector means comprising a plurality of anode and cathode connectors welded respectively to the anode and cathode plate supports at said adjusted positions, and screw threaded means detachably securing said anode and cathode connectors to their respective sides of said partition.

9. The combination according to claim 8, said screw threaded means comprising a plurality of studs associated with the connectors respectively at one side of said partition and welded to said one side, each stud having a threaded shank extending traversely away from said one side and through the associated connector, and means for removably securing each connector at said one side to the associated stud comprising a nut screwed on the shank of the associated stud.

10. The combination according to claim 8, said screw threaded means comprising a plurality of anode studs and cathode studs associated respectively with the anode connectors and cathode connectors and welded to the anode and cathode side respectively of said partition, each stud having a threaded shank extending transversely away from the partition side to which it is welded, means for supporting each connector on an associated threaded shank at a predetermined position of angular adjustment with respect to the axis of the shank, and the means for removably mounting each connector on its respective side of said partition also comprising a nut screwed on the associated shank for securing the connector at said position of angular adjustment.

11. The combination according to claim 10, said anode and cathode studs comprising two sets of studs, each stud of at least one set having a second shank extending oppositely from its first named shank and screwed into a threaded bore in said partition.

12. The combination according to claim 10, each stud having a second threaded shank extending oppositely from its first named shank, one of said oppositely extending threaded second shanks being screwed into a threaded bore in said partition and having an internally threaded bore, the other of said oppositely extending threaded shanks being screwed into said internally threaded bore.

13. The method of fabricating a unit of a flat plate bipolar electrolytic cell having a centerboard spacing parallel anode and cathode plates; comprising the steps of (a) providing a plurality of anode and cathode ribs having anode and cathode plate supporting edges respectively adapted to be arranged in parallel planes and welded to said anode and cathode plates respectively for supporting the same in preselected planes;

(b) providing for each rib an associated plurality of connectors and securing means for removably securing said connectors to said centerboard at spaced locations;

(c) utilizing said securing means for removably securing said connectors to said centerboard at said locations and while thus secured, (d) arranging said ribs at adjusted positions relative to said connectors to compensate for deviations of said centerboard from a plane surface parallel to said plates and to locate said edges in said preselected planes;

(e) welding said ribs in said adjusted positions to the associated connectors;

(f) utilizing said securing means for removing the welded together connectors and ribs from the centerboard;

(g) while thus removed from said partition, welding said anode and cathode plates to said edges; and (h) thereafter assembling the welded together plates, ribs, and connectors to said centerboard by utilizing said securing means for securing said connectors to said centerboard.

14. The method according to claim 13, wherein step (e) comprises welding each rib to the associated connectors spaced along the length of the rib, and step (g) comprises resistance welding each plate to said edges throughout the length of said edges between said connectors.

15. The method according to claim 13 wherein steps (a) and (b) comprise the provision of said ribs and connectors with mating engagable surfaces shaped to enable relative movement of said ribs with respect to said connectors in directions transverse to said centerboard to said adjusted positions while remaining in engagement with each other, wherein step (d) comprises moving said ribs in said directions to said adjusted positions while maintaining said surfaces in said engagement with each other.

16. In a bipolar electrolytic cell having a series of adjacent cell units, each unit comprising parallel anode and cathode plates spaced by a partition supported within a peripheral flange, said partition comprising a composite structure of anode and cathode sheets defining anode and cathode sides respectively of said partition and confronting said anode and cathode plates respectively and having a plurality of surface locations variously spaced from their confronting plates, the combination of means associated with each cell unit for supporting the cathode and anode plates of adjacent units in predetermined closely spaced parallelism and for effecting an electrical connection between the anode and cathode plates of the associated cell unit comprising a plurality of anode and cathode connector means, means for removably securing said anode and cathode connector means at said locations to the anode and cathode sides respectively of the partition of the associated cell unit, and means for supporting the anode and cathode plates of the associated cell unit in parallelism at predetermined spaced positions independently of variations in the distances between said plates and said surface locations including a plurality of anode and cathode plate supports having anode and cathode plate supporting edges respectively and being individually arranged at adjusted positions relative to said removably secured anode and cathode connector means respectively, with their anode and cathode plate supporting edges at each side of said partition in a predetermined plane parallel to the other such plane at the opposite side of said partition, said anode and cathode plate supports being secured at said adjusted positions to said anode and cathode connector means respectively, and said anode and cathode plate supporting edges being welded to said anode and cathode plates respectively of the associated cell unit.

17. The combination according to claim 16, said anode and cathode supports being welded to said anode and cathode connector means respectively.

* * * * *

UNITED STATES PATENT AND TRADEMARK OFFICE

CERTIFICATE OF CORRECTION

PATENT NO. : 4,726,891

DATED : February 23, 1988

INVENTOR(S) : Richard N. Beaver; Hiep D. Dang

It is certified that error appears in the above-identified patent and that said Letters Patent is hereby corrected as shown below:

Col. 3, line 39, "BRIED" should read -- BRIEF --.

Col. 5, line 68, "alone" should read -- plane --.

Col. 9, line 2, "opening" should read -- openings --.

Signed and Sealed this

Fifteenth Day of November, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,726,891

DATED : February 23, 1988

INVENTOR(S) : Richard N. Beaver; Hiep D. Dang

It is certified that error appears in the above-identified patent and that said Letters Patent is hereby corrected as shown below:

Col. 10, line 16, delete "predetermined".

Signed and Sealed this

Twenty-fourth Day of January, 1989

*Attest:*

DONALD J. QUIGG

*Attesting Officer*

*Commissioner of Patents and Trademarks*